US006739266B1

(12) United States Patent
Castano et al.

(10) Patent No.: US 6,739,266 B1
(45) Date of Patent: May 25, 2004

(54) HIGH-SPEED SUPERCAVITATING UNDERWATER VEHICLE

(75) Inventors: John M. Castano, Portsmouth, RI (US); Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/663,055

(22) Filed: Sep. 15, 2003

(51) Int. Cl.[7] ..... F42B 15/20; F42B 15/22; F42B 19/00

(52) U.S. Cl. ..... 102/399; 114/20.1

(58) Field of Search ..... 102/399; 114/20.1

(56) References Cited

U.S. PATENT DOCUMENTS 3,434,425 A * 3/1969 Critcher ..... 102/399
3,915,092 A * 10/1975 Monson et al. ..... 102/399
4,271,552 A * 6/1981 Sandler ..... 441/30
5,929,370 A * 7/1999 Brown et al. ..... 102/399
5,955,698 A * 9/1999 Harkins et al. ..... 102/399
6,405,653 B1 * 6/2002 Miskelly ..... 102/374

* cited by examiner

*Primary Examiner*—Michael J. Carone
*Assistant Examiner*—H. A. Blackner
(74) *Attorney, Agent, or Firm*—James M. Kasischke; Michael F. Oglo; Jean-Paul A. Nasser

(57) ABSTRACT

A high-speed supercavitating underwater vehicle includes an elongated hull of circular cross section, the hull having a cavitator at a forward end thereof and means for ventilating gas to form a cavity around the hull in underwater travel. An expandable annular skirt is fixed on the hull and is provided with an outer surface proximate an outer surface of the hull. The skirt is expandable to increase a diameter of the skirt from proximate a diameter of the hull to proximate a diameter of the cavity to define an annular gas film between the expanded skirt and a boundary of the cavity. The expanded skirt acts to substantially reduce the flow of gas from a forward high pressure zone of gas to an after low pressure zone of gas.

9 Claims, 5 Drawing Sheets

HIGH-SPEED SUPERCAVITATING UNDERWATER VEHICLE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to high-speed underwater vehicles, and is directed more particularly to supercavitating vehicles which move in a cushion of air underwater.

(2) Description of the Prior Art

Recent investigations into high-speed underwater vehicles have focused attention on providing vehicles which ride a cushion of air to achieve high speeds in water. For a nominal prior art streamlined, fully-wetted underwater vehicle, 70% of the overall drag is skin friction drag; the remainder is pressure or blockage drag. Supercavitation allows for much higher speeds to be sustainable by eliminating, or drastically reducing, skin friction drag at the higher speeds. The conditions for supercavitation require that enough energy be put into the water to vaporize a given volume of water through which an object can travel. This is done by accelerating fluid over a sharp edge, usually the nose of a vehicle, such as a torpedo, so that the pressure drops below the vapor pressure of water. If the speed of the object is not fast enough to travel through the vapor cavity before the cavity collapses, artificial ventilation into the cavity can keep the cavity "open" until the object moves past. When a cavity completely encapsulates an object, by vaporous and/or vented cavitation, it is referred to as "supercavitation". The vehicle nose, or "cavitator", is the only part of the object in constant contact with the water through which the vehicle travels. The cavity closure is positioned behind the vehicle.

When the cavitator and artificial ventilation generate the necessary cavity properties, i.e., sufficient length and diameter of air cushion, it results in a larger air gap between the vehicle and water than is otherwise necessary at the after end of the vehicle. The air, or other selected gas, is drawn through the gap by a propulsion jet plume, and escapes into the ambient water.

It has been found desirable to minimize the downstream entrainment effect of the propulsion plume, to thereby minimize loss of air and to increase life expectancy of a reservoir of ventilation air on-board the vehicle.

SUMMARY OF THE INVENTION

An object of the invention is, therefore, to provide a high-speed underwater supercavitating vehicle in which the air cavity at the aft end of the vehicle is reduced while the air cavity otherwise remains appropriately sized and configured for vehicle travel.

With the above and other objects in view, as will hereinafter appear, a feature of the present invention is the provision of a high-speed supercavitating underwater vehicle comprising an elongated hull of circular cross section, the hull having a cavitator at a forward end thereof and means for ventilating gas to form a cavity around the hull in underwater travel, and an expandable annular skirt fixed on the hull and having an outer surface generally contiguous with an outer surface of the hull. The skirt is expandable to increase a diameter of the skirt from slightly above a diameter of the hull to proximate a diameter of the cavity, to define an annular gas film between the expanded skirt and a boundary of the cavity, whereby to substantially reduce the flow of gas from a forward high pressure zone to an after low pressure zone.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
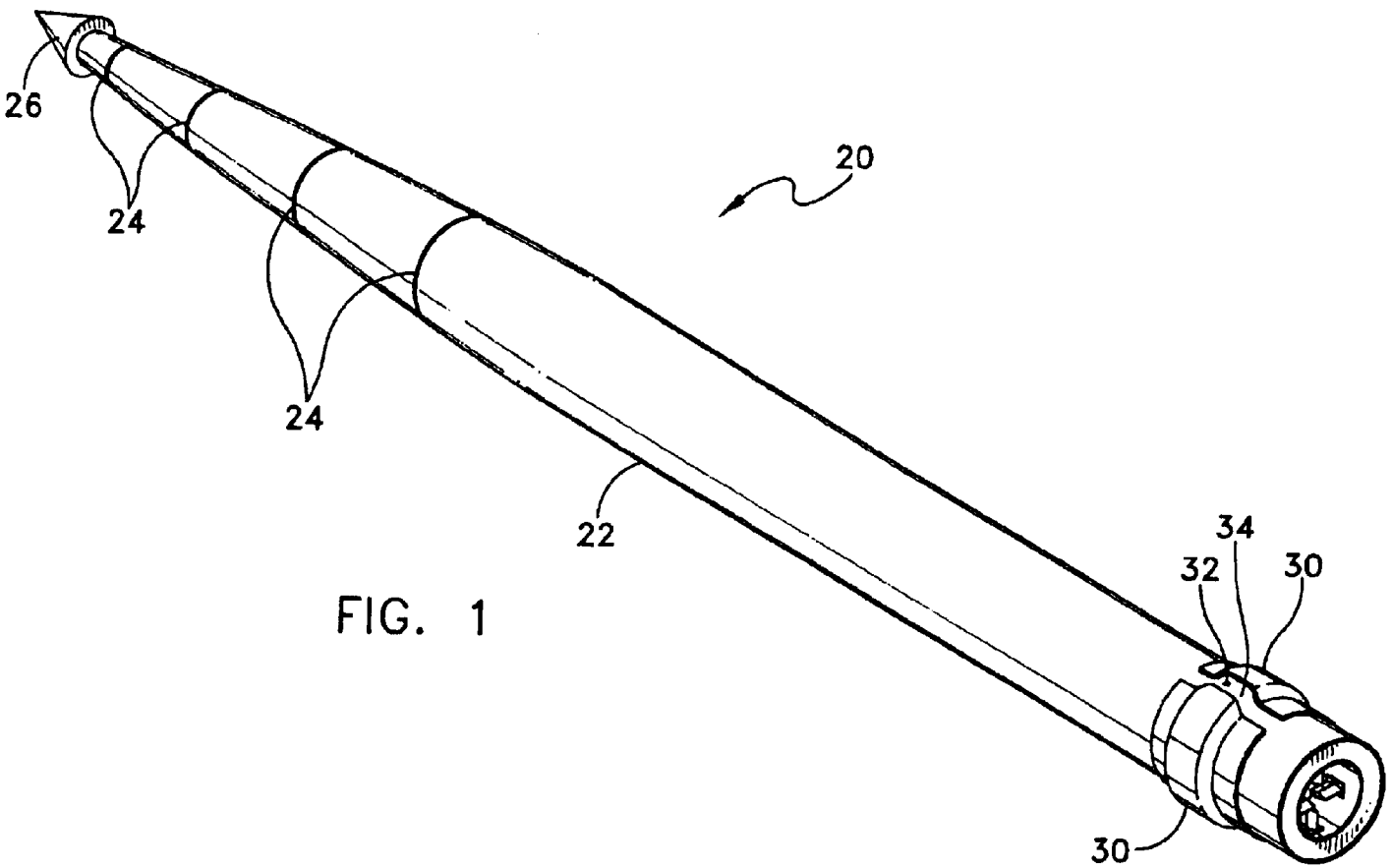
FIG. 1 is a perspective, broken away view of one form of underwater vehicle illustrative of an embodiment of the invention.

Referring to FIG. 1, it will be seen that an illustrative underwater vehicle 20 includes an elongated hull 22 of circular cross section. The hull is provided with peripheral grooves or apertures 24 for venting gas, typically air, under pressure stored in the vehicle. The hull 22 is provided with a cavitator shown herein as a pointed nose cone 26 at its forward end. The hull 22 contains a reservoir of gas under pressure for venting through the grooves 24, and a jet engine for propelling the hull 22 forward at a rapid rate. The after end of the hull 22 is open to accommodate a jet plume 28 (FIG. 2) when the jet engine is in operation.

An expandable annular skirt 30 is fixed on and around the hull 22. In a non-expanded condition, the skirt 30 extends substantially coextensively with the hull outer surface, the inside diameter of the skirt being substantially equal to the outside diameter of the hull 22. The skirt 30 is a relatively thin sheet of elastomeric material and adds little to the overall outside diameter of the vehicle.

The skirt 30 is expandable, as by the flow of pressurized gas through apertures 32 (FIG. 1) into a region 34 between the outer surface of the hull 22 and the inner surface of the skirt 30.

Figure 2:
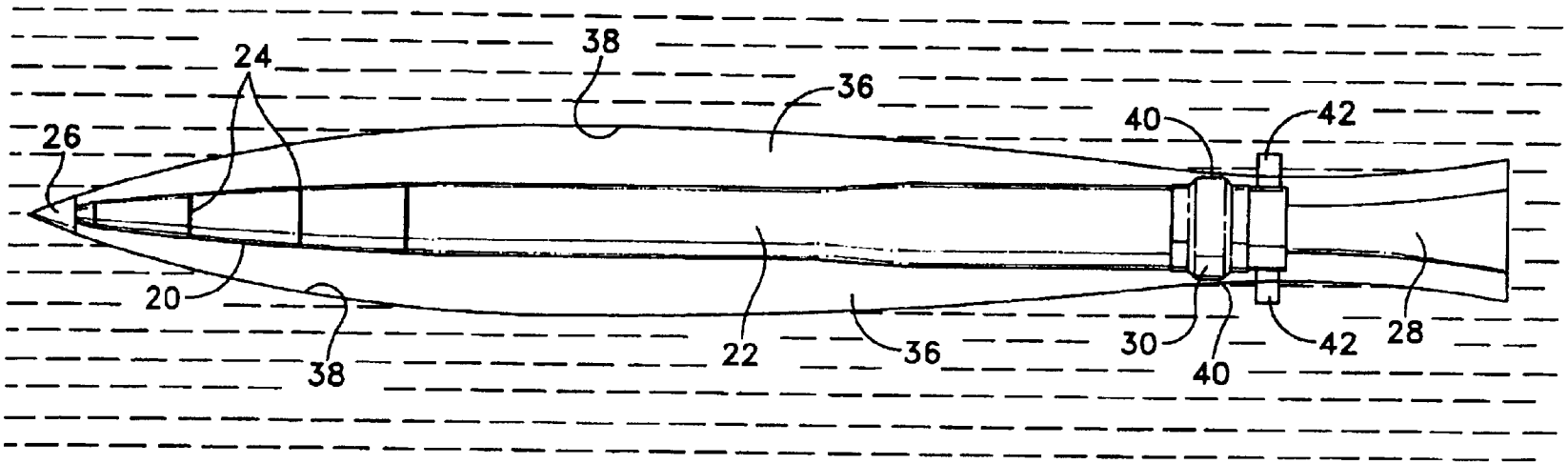
FIG. 2 is a diagrammatic side elevational view of the vehicle of FIG. 1 shown underwater.

Referring to FIG. 2, it will be seen that the forward movement of the vehicle 20 causes the nose cone 26, which acts as a cavitator, to create a cavity 36, or vapor region, behind the cone 26. The outflow of pressurized gas from the grooves 24 enlarges the cavity 36 and maintains the cavity such that the water-gas interface, or cavity boundary 38, is spaced from the vehicle 20, except at the nose cone 26. Thus, the vehicle 20 is not subjected to the friction of water, except at the nose cone.

Without the skirt 30 herein described, the jet plume 28 draws the gas surrounding the vehicle into the plume 28 very quickly, thereby causing the gas reservoir in the hull to be quickly exhausted, thereby shortening the range of the vehicle.

However, the skirt 30, when expanded, occupies almost all of the gas cavity 36 forward of the jet plume 28, leaving only an annular thin film 40 of gas around the skirt, as shown in FIG. 2. The gas cavity forward of the skirt becomes a high pressure zone and the gas cavity aft of the skirt becomes a lower pressure zone. The gas in the forward zone escapes at a much lower pace, holding its pressure for a longer time, maintaining the cavity for a longer time, and thereby affording a substantially increased range for the vehicle.

Figure 3B:
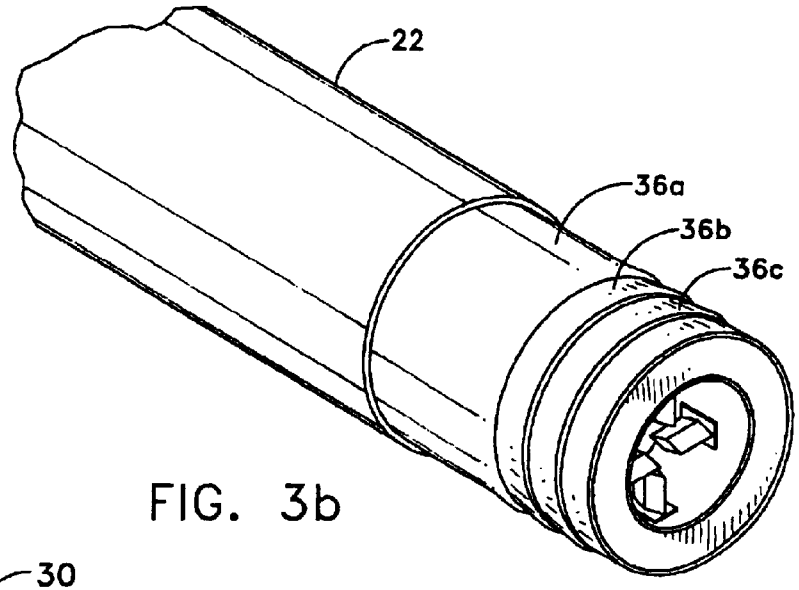
FIGS. 3*a* and 3*b* are perspective views of alternative embodiments of skirt portions of the vehicle shown in FIGS. 1 and 2.
Figure 3A:
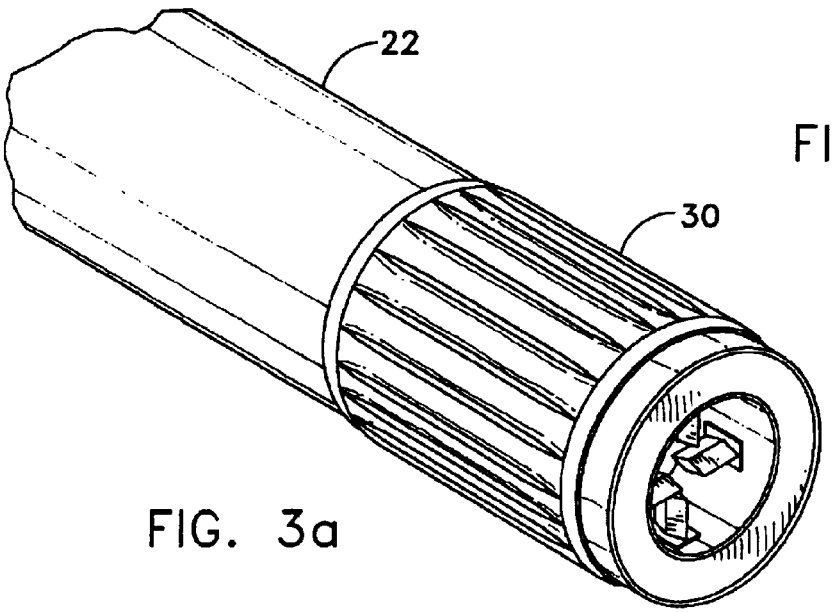
Figure 4B:
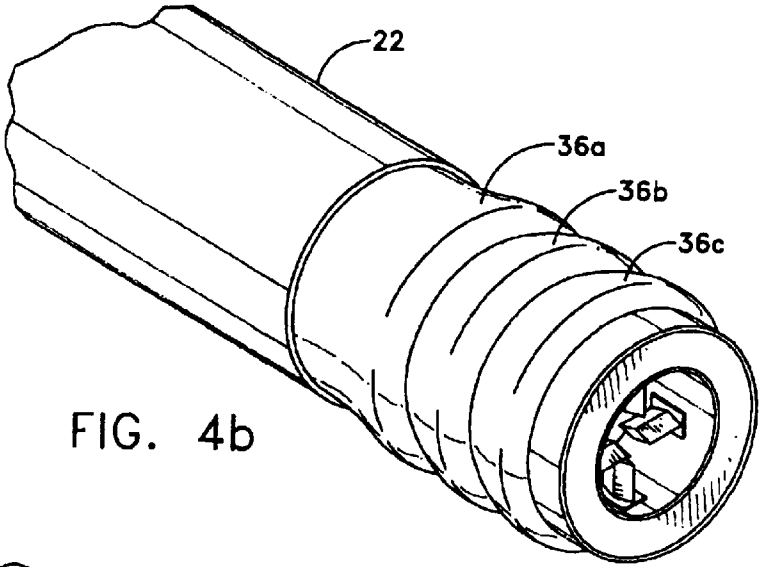
FIGS. 4*a* and 4*b* are perspective views similar, respectively, to FIGS. 3*a* and 3*b*, but showing the skirt portions expanded.
Figure 4A:
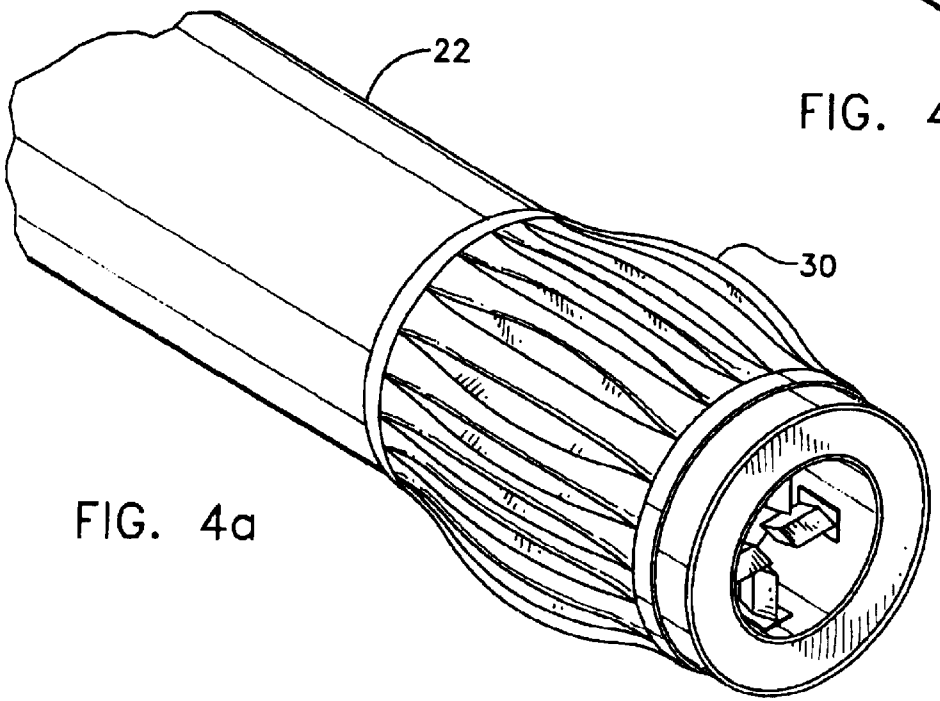
Figure 5:
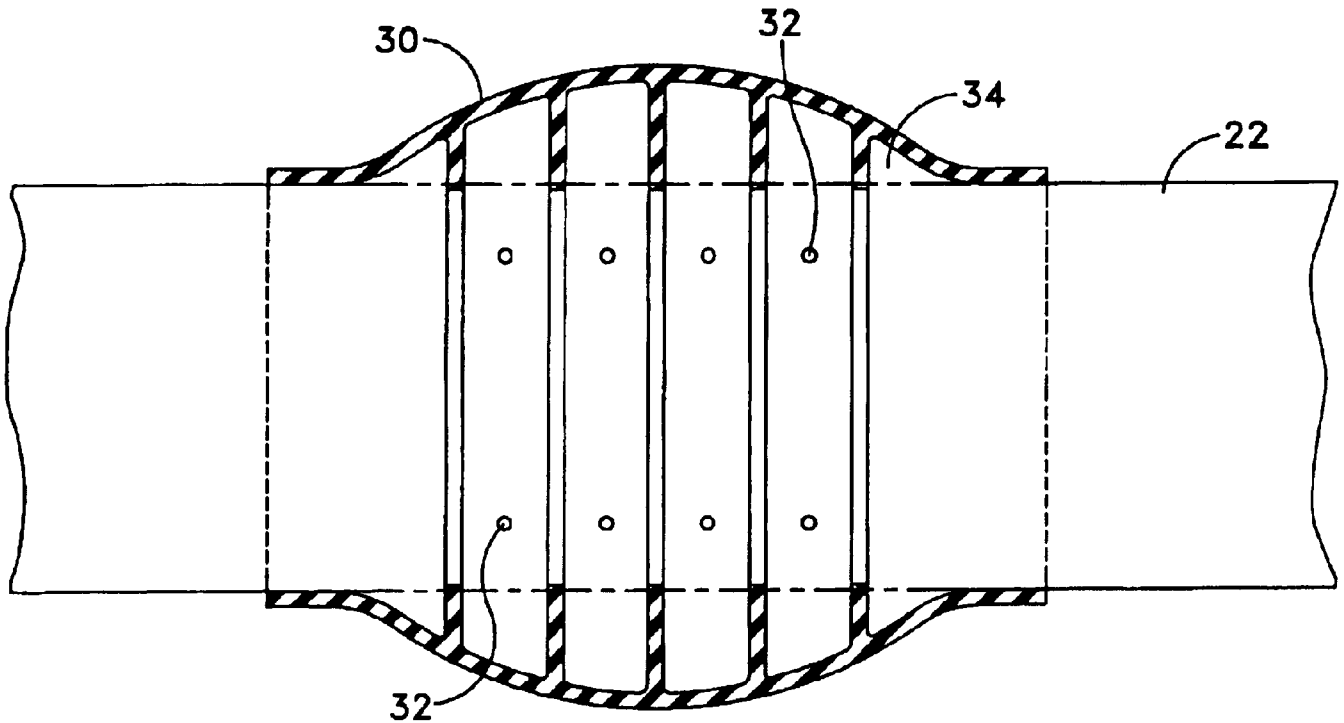
FIG. 5 is a sectional view of an alternative skirt portion of the vehicle.

In a preferred embodiment, illustrated in FIGS. 3*a* and 4*a*, the skirt 30 is pleated. The pleated structure, in addition to the elastomeric material of the skirt, provides the skirt with a relatively wide range for expansion. In another embodiment shown in FIG. 3*b* and FIG. 4*b,* skirt 30 is made from annular bags 36*a*, 36*b* and 36*c*. As shown in FIG. 3*b,* bags 36*a,* 36*b,* 36*c* overlap one another when deflated. Each annular bag 36 has an associated gas supplying aperture 32 providing redundancy in case of bag failure. In addition, the skirt may include discrete compartments 34, as shown in FIG. 5, each compartment having a gas supplying aperture 32 therein, such that damage to the skirt in a given area does not necessarily cause failure of a mission.

The vehicle 20 may be provided with fins 42 mounted on the hull 22 and adapted to extend beyond the cavity 36 for purposes of stabilization and/or guidance.

There is thus provided an underwater vehicle having facility for high-speed movement underwater and having means for maintaining an air cavity, or cushion, through which the vehicle moves, to reduce the rate of consumption of ventilation gas stored on the vehicle, and thereby increase the range of the vehicle.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A high-speed supercavitating underwater vehicle comprising:

an elongated hull of circular cross section, the hull having a cavitator at a forward end thereof, and means for ventilating gas positioned in said hull to form a cavity around said elongated hull in underwater travel; and an expandable annular skirt fixed on said hull and having an outer surface generally continuous with an outer surface of said hull, said skirt being expandable to increase a diameter of said skirt from proximate a diameter of said hull to proximate a diameter of the cavity, whereby to substantially reduce the flow of gas past said skirt.

2. The underwater vehicle in accordance with claim 1 wherein said skirt is pleated.

3. The underwater vehicle in accordance with claim 1 wherein said skirt comprises a plurality of discrete cells.

4. The underwater vehicle in accordance with claim 2 wherein said skirt comprises a plurality of discrete radially extending cells.

5. The underwater vehicle in accordance with claim 1 wherein said skirt comprises a radially extendible annular bag.

6. The underwater vehicle in accordance with claim 1 wherein said skirt comprises a plurality of radially extendible annular bags.

7. The underwater vehicle in accordance with claim 6 wherein said bags are inflatable.

8. The underwater vehicle in accordance with claim 7 wherein each of said bags overlays at least one neighboring bag when said bags are in a deflated condition.

9. The underwater vehicle in accordance with claim 1 and further comprising stabilizing fins fixed to said hull and extending beyond the boundary of the cavity.

* * * * *